US008168582B2

(12) United States Patent
Blanco et al.

(10) Patent No.: US 8,168,582 B2
(45) Date of Patent: May 1, 2012

(54) FABRIC SOFTENING COMPOSITION COMPRISING A POLYMERIC VISCOSITY MODIFIER

(75) Inventors: Paul William Blanco, Wirral (GB); Allen Mark Carrier, Hixson, TN (US); Michael Douglas Eason, North Cave (GB); Christopher Gerald Gore, Cartersville, GA (US); Sarah Louise Roberts, Kingston-upon-Thames (GB); Stephane Patrick Roth, Kingston-upon-Thames (GB); Joseph Steven Maxim, Jr., Hixson, TN (US)

(73) Assignee: The Sun Products Corporation, Wilton, CT (US)

( * ) Notice: Subject to any disclaimer, the term of this patent is extended or adjusted under 35 U.S.C. 154(b) by 520 days.

(21) Appl. No.: 11/922,117

(22) PCT Filed: May 23, 2006

(86) PCT No.: PCT/EP2006/004895

§ 371 (c)(1),
(2), (4) Date: Jul. 16, 2008

(87) PCT Pub. No.: WO2006/133792

PCT Pub. Date: Dec. 21, 2006

(65) Prior Publication Data

US 2009/0291876 A1 Nov. 26, 2009

(30) Foreign Application Priority Data

Jun. 14, 2005 (GB) ..... 0512095.1

(51) Int. Cl.
*C11D 1/62* (2006.01)
*C11D 3/37* (2006.01)
*C11D 1/835* (2006.01)

(52) U.S. Cl. ..... 510/515; 510/276; 510/287; 510/289; 510/308; 510/322; 510/327; 510/329; 510/330; 510/331; 510/353; 510/358; 510/421; 510/437; 510/491; 510/504

(58) Field of Classification Search ..... 510/276, 510/287, 289, 308, 322, 327, 329, 330, 331, 510/353, 358, 421, 437, 491, 504, 515
See application file for complete search history.

(56) References Cited

U.S. PATENT DOCUMENTS

| | | | | | |
|---|---|---|---|---|---|
| 3,936,538 | A | * | 2/1976 | Marshall et al. | 510/519 |
| 4,129,694 | A | * | 12/1978 | Cogliano et al. | 521/107 |
| 4,155,892 | A | * | 5/1979 | Emmons et al. | 524/507 |
| 4,292,412 | A | | 9/1981 | Wood | 521/107 |
| 4,499,233 | A | * | 2/1985 | Tetenbaum et al. | 524/591 |
| 5,407,588 | A | * | 4/1995 | Butterworth et al. | 510/524 |
| 5,939,377 | A | * | 8/1999 | Ewbank et al. | 510/475 |
| 6,727,220 | B1 | * | 4/2004 | Grainger et al. | 510/475 |
| 2004/0144950 | A1 | * | 7/2004 | Chrobaczek et al. | 252/8.61 |
| 2006/0135399 | A1 | * | 6/2006 | Grandmaire et al. | 510/515 |
| 2007/0264293 | A1 | * | 11/2007 | Elder et al. | 424/401 |
| 2009/0124533 | A1 | * | 5/2009 | Kottke et al. | 510/527 |

FOREIGN PATENT DOCUMENTS

| | | | |
|---|---|---|---|
| DE | 9107984.5 | * | 10/1992 |
| DE | 91 07 984 | | 12/1992 |
| EP | 0 385 749 | | 4/1996 |
| EP | 385749 | * | 4/1996 |
| WO | 00/04118 | | 1/2000 |
| WO | 02/081611 | * | 10/2002 |

OTHER PUBLICATIONS

PCT Search Report in a PCT application PCT/EP2006/004895.
GB Search Report in a GB application GB 0512095.1, Oct. 17, 2005.

* cited by examiner

*Primary Examiner* — Charles Boyer
(74) *Attorney, Agent, or Firm* — Sterne, Kessler, Goldstein & Fox P.L.L.C.

(57) ABSTRACT

A liquid fabric treatment composition comprising a cationic fabric softening agent and a water-soluble linear polymeric viscosity modifier represented by the formula: Z—Y—(X—Y)$_n$—Z in which: X represents a polyether chain, each Y independently represents a linking group derived from a diisocyanate, each Z independently represents a hydrophobic group and optionally includes a spacer linked to Y, n represents an integer of at least 2, and the molecular weight of the polymer is from 2,000 to 80,000.

18 Claims, 1 Drawing Sheet

FABRIC SOFTENING COMPOSITION COMPRISING A POLYMERIC VISCOSITY MODIFIER

TECHNICAL FIELD

The present invention relates to fabric softening compositions. In particular the invention relates to fabric softening compositions that are visually and rheologically appealing to consumers.

BACKGROUND AND PRIOR ART

It is well known to provide liquid fabric softening compositions that soften treated fabric. Such compositions are typically added to fabric in the rinse cycle of the wash process. It has been observed that consumer preference is for liquid fabric conditioners that appear thick and creamy, cued by having a high viscosity and a high opacity. Conditioners that appear thin and/or translucent/watery may be perceived as being cheap and ineffective, whereas conditioners that appear thick and creamy are perceived as premium products. To date, there is limited technology that allows the alteration of viscosity and opacity without causing problems such as poor dispensing or poor storage stability.

We have found that liquid fabric conditioners that appear thick and creamy may be prepared by adding particular levels of an emulsified oil of particular particle size to a dispersion of conventional cationic fabric softening agent in water.

Fabric conditioners comprising polymeric viscosity modifiers and cationic softening agent are known in the art. For example, WO-A1-02/081611 discloses a fabric softener composition for the treatment of textile fiber materials in domestic applications comprises a fabric softener and a water-soluble polyurethane obtainable by reaction of (a) a diisocyanate, with (b) a polyether containing at least one hydroxyl group, (c) optionally a diol derived from an aliphatic residue having from 2 to 12 carbon atoms, and (d) an agent introducing a water-solubilising group.

U.S. Pat. No. 5,939,377 discloses fabric softening compositions comprising a fatty alcohol ethoxylate-diurethane polymer as a thickening agent. U.S. Pat. Nos. 4,129,694 and 4,292,412 disclose fabric softener compositions comprising a cross-linking urethane foam forming system.

EP-A2-0385749 discloses fabric conditioning compositions comprising a quaternary ammonium softening material and a polymeric thickener. The thickener has a hydrophilic backbone and two hydrophobic groups attached thereto.

Our co-pending application GB0408012.3 discloses thick and creamy compositions comprising an aqueous base, a cationic fabric Softening agent, and an emulsified oil in an amount such that the weight ratio of oil to cationic fabric softening agent is from 1:12 to 1:1, characterised in that the D[4,3] droplet size of the emulsified oil is from 0.4 to 8 microns.

SUMMARY OF INVENTION

According to a first aspect of the invention, there is provided a liquid fabric treatment composition comprising a cationic fabric softening agent and a water-soluble polymeric viscosity modifier represented by the formula:

$$Z—Y—(X—Y)_n—Z$$

in which:

X represents a polyether chain, each Y independently represents a linking group derived from a diisocyanate, each Z independently represents a hydrophobic group and optionally includes a spacer linked to Y, n represents an integer of at least 2, and the molecular weight of the polymer is from 2,000 to 80,000.

According to a second aspect of the present invention, there is provided a method for the treatment of fabrics comprising contacting fabrics with a liquid fabric treatment composition according to the first aspect of the invention or any of the particular variants thereof disclosed in the following description.

In the context of the present invention, the term "comprising" means including and is non-exhaustive.

DETAILED DESCRIPTION OF THE INVENTION

The compositions of the present invention are thick and creamy and yet remain sufficiently dispensable from the rinse compartment drawer of an automatic washing machine.

It has been found that thicker and creamier compositions are desirable to consumers since it is easier to control the rate of pouring from the bottle into the rinse compartment drawer and because such a rheology is typically associated with a high quality product.

Nevertheless, it is well known that a thicker product is often less dispensable from the drawer and so is less effective.

It has been found that a level of residue of about 20% or more by weight of the composition is unacceptable.

The compositions of the invention have surprisingly high turbidity and appear thick and creamy to the consumer. Despite this fact, they leave little residue in the dispenser draw of automatic washing machines and are stable for prolonged periods of time, even at non-ambient temperatures.

Viscosity

Viscosity of standard commercial liquid fabric softener formulations can be measured using a range of different techniques and instrumentation. The viscosity of these commercial formulations can affected by the concentration and selection of the active ingredients, the method of manufacturing process and by the addition of thickening agents.

Current commercial fabric conditioner formulations that are thickened with conventional high molecular weight associative polymeric thickeners typically have a viscosity range, at room temperature, from 50-150 mPa s at a sheer rate of 100 $s^{-1}$ and demonstrate sheer thinning behaviour. As viscosity rises in excess of 100 mPa s then the dispensing properties of the product become unacceptable to consumers.

The invention allows products to be prepared with viscosity of over 1000 mPa s. However, the polymers used in the invention have a flatter (more Newtonian) profile at the shear rates relevant to dispensing from a washing machine dispenser drawer; ~2 $s^{-1}$ than polymers of the prior art. This ensures good dispensing without low or no residue.

The polymers used in the invention show lower viscosity at the dispensing shear rate but a higher viscosity at the pouring shear rate where consumers experience the thickness effect. This type of shear profile behaviour provided by the polymers of the invention is very unexpected and novel.

Polymeric Viscosity Modifier

The polymeric viscosity modifier is a linear polyurethane polymer comprising a polyether chain and hydrophobic end groups and is represented by the formula:

$$Z—Y—(X—Y)_n—Z$$

in which:

X represents a polyether chain, each Y independently represents a linking group derived from a diisocyanate, each Z independently represents a hydrophobic group and optionally includes a spacer linked to Y, n represents an integer of at least 2 and the molecular weight of the polymer is from 2,000 to 80,000.

The molecular weight of the polymer is generally from 5,000 to 35,000, more preferably from 7,500 to 30,000. The polymer is not cross-linked.

Previously, polymeric thickeners having higher molecular weights were more desirable because larger molecules would interact and effectively entangle other molecules within a composition more readily.

However, the problem is that such compositions are harder to dispense and disperse in an automatic washing machine.

Nevertheless, lower molecular weight polymers were not desirable in view of their believed inability to thicken adequately.

It has now been found that certain lower molecular weight polymers can thicken compositions sufficiently but allow the composition to remain dispensable and dispersible in use.

Preferably each Z comprises an aliphatic group of from 11 to 24 carbon atoms, preferably from 14 to 16 carbon atoms. Alkyl groups are preferred.

Z may comprise a spacer linked to Y. Suitable spacers include ethoxy, propoxy, polyethylene glycol etc.

Z is generally derived from an α-hydroxy substituted aliphatic group which results in a urethane linkage or an α-amino substituted aliphatic group which results in a urea linkage.

X is generally a poly(oxyalkylene) chain in which the alkylene groups contain from 2 to 6 carbon atoms. X is preferably polyoxyethylene glycol.

Y is derived from an aliphatic, cycloaliphatic or aromatic diisocyanate.

The polymers may be prepared, for example, by reaction of a) a diisocyanate b) a polyether containing at least one hydroxyl group and c) an α-hydroxy substituted aliphatic group of 11 to 24 carbon atoms or an α-amino substituted aliphatic group of 11 to 24 carbon atoms.

Component a) may be an aliphatic, cycloaliphatic or aromatic diisocyante. Component a) may be a $C_2$-$C_{12}$alkylene diisocyanate; $C_6$-$C_{12}$cyclohexylene diisocyanate; phenylene or napththylene diisocyanate which can be further substituted by $C_1$-$C_4$alkyl, $C_1$-$C_4$alkoxy, halogen or nitro; or diphenylmethane diisocyanate which can be further substituted in the phenyl rings by $C_1$-$C_4$alkyl, $C_1$-$C_4$alkoxy or halogen. Preferred are isophorone diisocyanate, the diphenylmethane diisocyanates and the $C_2$-$C_{12}$alkylene diisocyanates and phenylene diisocyanates mentioned above.

Examples of component a) include tolylene diisocyanate, xylylene diisocyanate, diphenylmethane diisocyanate, napththalene diisocyanate, 1,3-bis(isocyanatomethyl)cyclohexane, tetramethylxylylene diisocyante, hexamethylene diisocyanate, isophorone diisocyanate, dicyclohexylmethane diisocyanate and norborane diisocyanate. A preferred diisocyante is isophorone diisocyanate. The diisocyanates may be used in combinations or subsequent additions or 2 or more. Among these are particularly preferred combinations of xylylene diisocyanate and isophorone diisocyanate, xylylene diisocyanate and dicyclohexylmethane diisocyanate, xylylene diisocyanate and norborane diisocyanate, diphenylmethane diisocyanate and 1,3-bis(isocyanatomethyl)cyclohexane, diphenylmethane diisosyanate and isophorone diisocyanate, hexamethylene diisocyanate and isophorone diisocyanate, and hexamethylene diisocyanate and dicyclohexylmethane diisocyanate.

Component a) may a $C_2$-$C_{12}$alkylene diisocyanate, e.g. a $C_4$-$C_8$alkylene diisocyanate, or a compound of formula

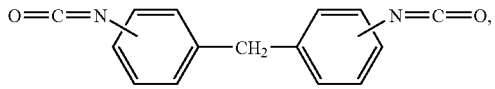

(2)

especially a compound of formula (2) wherein both isocyanate groups are bonded in para position, or

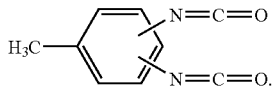

(3)

Examples of formula (3), include 2,4-toluoylene diisocyanate, and $C_4$-$C_8$alkylene diisocyanates.

Examples of components b) include polyoxyethylene glycol, polyoxyethylenepropylene glycol and polyoxyethylenetetramethylene glycol. Others may include addition products prepared by addition of ethylene oxide alone or ethylene oxide with one or more alkylene oxides such as propylene oxide or butylenes oxide, to low molecular weight polyalkylene polyamines such as ethylenediamine, diethylenetriamine and triethylenetetramine, or hydrazine.

Components b) preferably have a molecular weight of 600-30,000.

Preferably, component b) is a polyether of formula $$R_1—(O—X_1)_n—OH \quad (4)$$

wherein $R_1$ is hydrogen or $C_1$-$C_{12}$alkyl, $X_1$ is $C_2$-$C_6$alkylene and n is a number from 2 to 100.

$R_1$ as $C_1$-$C_{12}$ alkyl is a straight-chain or branched alkyl radical such as methyl, ethyl, n-propyl, isopropyl, n-butyl, sec-butyl, tert-butyl, pentyl, iso-pentyl, tert-pentyl, hexyl, heptyl, octyl, isocytyl, nonyl or decyl and the like.

Preferred are $C_1$-$C_6$alkyl radicals, especially $C_1$-$C_4$alkyl radicals.

$R_1$, is preferably $C_1$-$C_{12}$alkyl as to which the above meanings and preferences apply.

$X_1$, is preferably $C_2$-$C_4$alkylene, like groups of formulae —$CH_2$—$CH_2$—, —$CH_2$—$CH_2$—$CH_2$—, —$CH(CH_3)$—$CH_2$— and —$CH_2$—$CH(CH_3)$— as well as linear or branched butylenes. Preferred are the corresponding branched alkylene groups.

n is an integer, generally from 5 to 500.

Preferred components b) of formula (4) are those wherein $R_1$ is $C_1$-$C_6$alkyl, $X_1$ is $C_2$-$C_4$alkylene and n is a number from 5 to 100.

The preparation of the polymers can be carried out according to known methods. For example, component a) is reacted with component b) and optionally with component c) in a solvent, like polar, aprotic, organic solvents. Examples for solvents are esters of organic acids or ethers. Particularly suitable solvents are lower ketones, like acetone, methyl ethyl ketone and methyl isobutyl ketone. Further solvents are tetrahydrofurane, dioxane, dimethylformamide, dimethylsulfoxide, toluene, xylene, ethyl acetate, butyl acetate and methylene chloride. Then the introduction of a water-solubilising group is carried out by addition of the corresponding agent, like $NaHSO_3$ at temperatures like those given above. The organic solvents can be removed again from the composition, e.g. by distillation.

The reaction is advantageously carried out in the presence of a catalyst. It is possible to use any catalysts which are suitable for the reaction of isocyanate groups with alcoholic hydroxyl groups. Examples of suitable catalysts are tertiary amines, including 1,4-diazabicyclo[2.2.2]-octane. Particularly suitable catalysts are organotin compounds. Examples for such catalysts are dibutyltin laurate, stannous octoate, dibutyltin-2-ethyl hexoate, or mixtures thereof with triethylamine, triethylenediamine or N-methylmorpholine. Reaction controller such as phosphoric acid, sodium hydrogen phosphate, para-toluenesulfonic acid, adipic acid or benzoyl chloride may be added.

The reaction is normally carried out at a temperature of from 0 to 150° C., preferably at a temperature of from 20 to 90° C., particularly preferably at a temperature of 40 to 80° C.

A particularly preferred polymer is represented by the following formula:

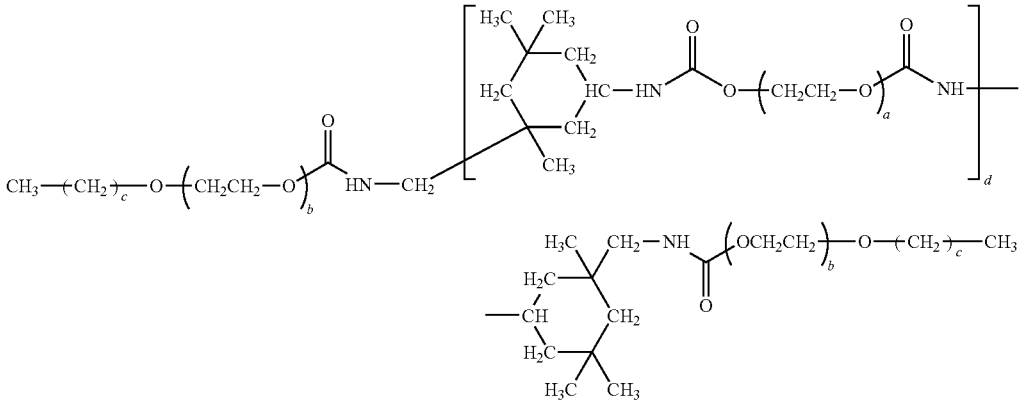

wherein a is from 2 to 20,000, b is from 0 to 30, c is from 10 to 24 and d is from 1-10.

The polymer (active ingredient) is preferably present at a level of from 0.001 to 2%, more preferably 0.01 to 1.6%, most preferably 0.2 to 1.1%, e.g. 0.3 to 1.0% by weight, based on the total weight of the composition.

Cationic Softening Agent

The cationic softening is generally one that is able to form a lamellar phase dispersion in water, in particular a dispersion of liposomes.

The cationic softening agent is typically a quaternary ammonium compound ("QAC"), in particular one having two $C_{12-28}$ groups connected to the nitrogen head group that may independently be alkyl or alkenyl groups, preferably being connected to the nitrogen head group by at least one ester link, and more preferably by two ester links.

The average chain length of the alkyl and/or alkenyl groups is preferably at least $C_{14}$ and more preferably at least $C_{16}$. It is particularly preferred that at least half of the groups have a chain length of $C_{18}$. In general, the alkyl and/or alkenyl groups are predominantly linear.

A first group of QACs suitable for use in the present invention is represented by formula (I):

$$[(CH_2)_n(TR)]_m\ R^1-\overset{|}{N^+}-[(CH_2)_n(OH)]_{3-m}\ X^- \quad (I)$$

wherein each R is independently selected from a $C_{5-35}$ alkyl or alkenyl group; $R^1$ represents a $C_{1-4}$ alkyl, $C_{2-4}$ alkenyl or a $C_{1-4}$ hydroxyalkyl group; T is generally O—CO. (i.e. an ester group bound to R via its carbon atom), but may alternatively be CO.O (i.e. an ester group bound to R via its oxygen atom); n is a number selected from 1 to 4; m is a number selected from 1, 2, or 3; and $X^-$ is an anionic counter-ion, such as a halide or alkyl sulphate, e.g. chloride or methylsulphate. Di-esters variants of formula I (i.e. m=2) are preferred and typically have mono- and tri-ester analogues associated with them. Such materials are particularly suitable for use in the present invention.

Especially preferred agents are di-esters of triethanolammonium methylsulphate, otherwise referred to as "TEA ester quats.". Commercial examples include Prapagen TQL, ex Clariant, and Tetranyl AHT-1, ex Kao, (both di-[hardened tallow ester] of triethanolammonium methylsulphate), AT-1 (di-[tallow ester] of triethanolammonium methylsulphate), and L5/90 (di-[palm ester] of triethanolammonium methylsulphate), both ex Kao, and Rewoquat WE15 (a di-ester of triethanolammonium methylsulphate having fatty acyl residues deriving from $C_{10}$-$C_{20}$ and $C_{16}$-$C_{18}$ unsaturated fatty acids), ex Witco Corporation.

The second group of QACs suitable for use in the invention is represented by formula (II):

$$(R^1)_3N^+-(CH_2)_n-\underset{\underset{CH_2TR^2}{|}}{CH}-TR^2\quad X^- \quad (II)$$

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; and wherein n, T, and $X^-$ are as defined above.

Preferred materials of this second group include 1,2 bis[tallowoyloxy]-3-trimethylammonium propane chloride, 1,2 bis[hardened tallowoyloxy]-3-trimethylammonium propane chloride, 1,2-bis[oleoyloxy]-3-trimethylammonium propane chloride, and 1,2 bis[stearoyloxy]-3-trimethylammonium propane chloride. Such materials are described in U.S. Pat.

No. 4,137,180 (Lever Brothers). Preferably, these materials also comprise an amount of the corresponding mono-ester.

A third group of QACs suitable for use in the invention is represented by formula (III):

$$(R^1)_2—N^+—[(CH_2)_n\text{-}T\text{-}R^2]_2X^- \quad (III)$$

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and n, T, and $X^-$ are as defined above. Preferred materials of this third group include bis(2-tallowoyloxyethyl)dimethyl ammonium chloride and hardened versions thereof.

A fourth group of QACs suitable for use in the invention is represented by formula (IV):

$$(R^1)_2—N^+\text{-}(R^2)_2X^- \quad (IV)$$

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and $X^-$ is as defined above. Preferred materials of this fourth group include di(hardened tallow)dimethylammonium chloride.

The iodine value of the softening agent is preferably from 0 to 120, more preferably from 0 to 100, and most preferably from 0 to 90. Essentially saturated material, i.e. having an iodine value of from 0 to 1, is used in especially high performing compositions. At low iodine values, the softening performance is excellent and the composition has improved resistance to oxidation and associated odour problems upon storage.

Iodine value is defined as the number of grams of iodine absorbed per 100 g of test material. NMR spectroscopy is a suitable technique for determining the iodine value of the softening agents of the present invention, using the method described in Anal. Chem., 34, 1136 (1962) by Johnson and Shoolery and in EP 593,542 (Unilever, 1993).

The softening agent is usually present in the compositions of the invention at a level of 2% to 75% by weight of the total composition. For even greater softening effect, this level may be 8% or greater; whilst for particularly high performance, this level may be 11% or greater. The level of softening agent is most preferably 10 to 30% by weight, e.g. 12.5 to 28% by weight. At these concentrations, which are also desirable for supply chain and environmental reasons, the low dispenser residues found with the compositions of the present invention is particularly relevant and unexpected.

References to levels of cationic softening agent in this specification are to the total level of cationic softening agent, including all cationic components of a complex raw material that could enter the aqueous lamellar phase together. With a di-ester softening agent, it includes any associated mono-ester or tri-ester components that may be present.

For ease of formulation, the amount of softening agent is generally 50% or less, particularly 40% or less, and especially 30% or less by weight of the total composition, e.g. 0.5 to 8% by weight of the total composition.

Nonionic Surfactant

A nonionic surfactant may be present in order to stabilise the composition, or perform other functions such as emulsifying any oil that may be present.

Suitable nonionic surfactants include alkoxylated materials, particularly addition products of ethylene oxide and/or propylene oxide with fatty alcohols, fatty acids and fatty amines.

Preferred materials are of the general formula:

$$R—Y—(CH_2CH_2O)_zH$$

Where R is a hydrophobic moiety, typically being an alkyl or alkenyl group, said group being linear or branched, primary or secondary, and preferably having from 8 to 25, more preferably 10 to 20, and most preferably 10 to 18 carbon atoms; R may also be an aromatic group, such as a phenolic group, substituted by an alkyl or alkenyl group as described above; Y is a linking group, typically being O, CO.O, or CO.N($R^1$), where $R^1$ is H or a $C_{1-4}$ alkyl group; and z represents the average number of ethoxylate (EO) units present, said number being 8 or more, preferably 10 or more, more preferably 10 to 30, most preferably 12 to 25, e.g. 12 to 20.

Examples of suitable nonionic surfactants include the ethoxylates of mixed natural or synthetic alcohols in the "coco" or "tallow" chain length. Preferred materials are condensation products of coconut fatty alcohol with 15-20 moles of ethylene oxide and condensation products of tallow fatty alcohol with 10-20 moles of ethylene oxide.

The ethoxylates of secondary alcohols such as 3-hexadecanol, 2-octadecanol, 4-eicosanol, and 5-eicosanol may also be used. Exemplary ethoxylated secondary alcohols have formulae $C_{12}$-EO(20); $C_{14}$-EO(20); $C_{14}$-EO(25); and $C_{16}$-EO(30).

Polyol-based nonionic surfactants may also be used, examples including sucrose esters (such as sucrose monooleate), alkyl polyglucosides (such as stearyl monoglucoside and stearyl triglucoside), and alkyl polyglycerols.

Suitable cationic surfactants include single long chain ($C_{8-40}$) cationic surfactants. The single long chain cationic surfactant is preferably a quaternary ammonium compound comprising a hydrocarbyl chain having 8 to 40 carbon atoms, more preferably 8 to 30, most preferably 12 to 25 carbon atoms (e.g. quaternary ammonium compounds comprising a $C_{10-14}$ hydrocarbyl chain are especially preferred).

Examples of commercially available single long hydrocarbyl chain cationic surfactants which may be used in the compositions of the invention include: ETHOQUAD® 0/12 (oleylbis(2-hydroxyethyl)methylammonium chloride); ETHOQUAD® C12 (cocobis(2-hydroxyethyl)methyl ammonium chloride) and ETHOQUAD® C25 (polyoxyethylene(15)cocomethylammonium chloride), all ex Akzo Nobel; SERVAMINE KAC®, (cocotrimethylammonium methosulphate), ex Condea; REWOQUAT® CPEM, (coconutalkylpentaethoxymethylammonium methosulphate), ex Witco; cetyltrimethylammonium chloride; RADIAQUAT® 6460, (coconut oil trimethylammonium chloride), ex Fina Chemicals; NORAMIUM® MC50, (oleyltrimethylammonium chloride), ex Elf Atochem.

Preferably, the composition comprises an emulsifier that has an HLB of from 7 to 20, more preferably from 10 to 20, and most preferably from 15 to 20.

A particular surfactant may be useful in the present compositions alone or in combination with other surfactants. The preferred amounts of nonionic surfactant indicated below refer to the total amount of such materials that are present in the composition.

The total amount of nonionic surfactant that is present is preferably from 0.05 to 10%, more preferably 0.1 to 5%, and most preferably 0.35 to 3.5%, based on the total weight of the composition. If an oil is present in the composition, the weight ratio of the total amount of nonionic surfactant to the amount of emulsified oil is preferably from 1:30 to 1:1, in particular from 1:25 to 1:5, and especially from 1:20 to 1:10.

Aqueous Base

The compositions of the invention are typically aqueous.

The aqueous base typically comprises 80% or greater by weight of water; sometimes this figure may rise to 90% or greater, or 95% or greater. The water in the aqueous base typically comprises 40% or greater by weight of the total formulation; preferably this figure is 60% or greater, more preferably it is 70% or greater.

The aqueous base may also comprise water-soluble species, such as mineral salts or short chain ($C_{1-4}$) alcohols. The mineral salts may aid the attainment of the desired viscosity for the composition, as may water soluble organic salts and cationic deflocculating polymers, as described in EP 41,698 A2 (Unilever). Such salts may be present at from 0.001 to 1% and preferably at from 0.005 to 0.1% by weight of the total composition. Examples of suitable mineral salts for this purpose include calcium chloride and magnesium chloride. Short chain alcohols that may be present include primary alcohols, such as ethanol, propanol, and butanol, secondary alcohols such as isopropanol, and polyhydric alcohols such as propylene glycol and glycerol. The short chain alcohol may be added with cationic softening agent during the preparation of the composition.

Fatty Complexing Agent

A preferred additional component in the compositions of the present invention is a fatty complexing agent. Such agents typically have a $C_8$ to $C_{22}$ hydrocarbyl chain present as part of their molecular structure. Suitable fatty complexing agents include $C_8$ to $C_{22}$ fatty alcohols and $C_8$ to $C_{22}$ fatty acids; of these, the $C_8$ to $C_{22}$ fatty alcohols are most preferred. A fatty complexing agent is particularly valuable in compositions comprising a QAC having a single $C_{12-28}$ group connected to the nitrogen head group, such as mono-ester associated with a TEA ester quat. or a softening agent of formula II, for reasons of product stability and effectiveness.

Preferred fatty acid complexing agents include hardened tallow fatty acid (available as Pristerene, ex Uniqema).

Preferred fatty alcohol complexing agents include hardened tallow alcohol (available as Stenol and Hydrenol, ex Cognis, and Laurex CS, ex Albright and Wilson) and behenyl alcohol, a $C_{22}$ fatty alcohol, available as Lanette 22, ex Henkel.

The fatty complexing agent may be used at from 0.1% to 10%, particularly at from 0.5% to 5%, and especially at from 0.75 to 2% by weight, based on the total weight of the composition.

Perfume

The compositions of the invention typically comprise one or more perfumes. The perfume is preferably present in an amount from 0.01 to 10% by weight, more preferably 0.05 to 5% by weight, most preferably 0.5 to 4.0% by weight, based on the total weight of the composition.

Co-Softener

Co-softeners may be used together with the cationic softening agent. When employed, they are typically present at from 0.1 to 20% and particularly at from 0.5 to 10%, based on the total weight of the composition. Preferred co-softeners include fatty esters, and fatty N-oxides.

Fatty esters that may be employed include fatty monoesters, such as glycerol monostearate, fatty sugar esters, such as those disclosed WO 01/46361 (Unilever).

Further Optional Ingredients

The compositions of the invention may contain one or more other ingredients. Such ingredients include preservatives (e.g. bactericides), pH buffering agents, perfume carriers, fluorescers, colourants, hydrotropes, antifoaming agents, anti-redeposition agents, soil-release agents, polyelectrolytes, enzymes, optical brightening agents, anti-shrinking agents, anti-wrinkle agents, anti-spotting agents, anti-oxidants, sunscreens, anti-corrosion agents, drape imparting agents, anti-static agents, ironing aids and dyes.

A particularly preferred optional ingredient is an opacifier or pearlescer. Such ingredients can serve to further augment the creamy appearance of the compositions of the invention. Suitable materials may be selected from the Aquasol 0P30X range (ex Rohm and Haas), the PuriColour White range (ex Ciba) and the LameSoft™ range (ex Cognis). Such materials are typically used at a level of from 0.01 to 1% by weight of the total composition.

Product Use

The compositions of the present invention are preferably rinse conditioner compositions and may be used in the rinse cycle of a domestic laundry process.

The composition is preferably used in the rinse cycle of a home textile laundering operation, where, it may be added directly in an undiluted state to a washing machine, e.g. through a dispenser drawer or, for a top-loading washing machine, directly into the drum. Alternatively, it can be diluted prior to use. The compositions may also be used in a domestic hand-washing laundry operation.

It is also possible, though less desirable, for the compositions of the present invention to be used in industrial laundry operations, e.g. as a finishing agent for softening new clothes prior to sale to consumers.

Manufacture

The compositions according to the invention may be prepared by any of the means known in the art. In a preferred method of manufacture of a fabric softening composition, a solution of the polymer is prepared independently of a dispersion of the cationic fabric softening agent and the separate components are then mixed to provide a composition according to the invention. In practice, the polymer solution is post-dosed into the dispersion with mixing at ambient temperature. Alternatively, after the dispersion of the pre-melted cationic fabric softening agent into an aqueous base, the polymer solution can be added hot using methods known in the art.

Of course, it will be understood that the polymeric thickener can be used in any fabric treatment composition where a thick and creamy product which remains dispensable is desired.

EXAMPLES

The invention is further illustrated by the particular (non-limiting) examples described below. All amounts indicated are weight percentages of the total composition, unless otherwise indicated.

Polymers used in the different example formulations have the following molecular structure.

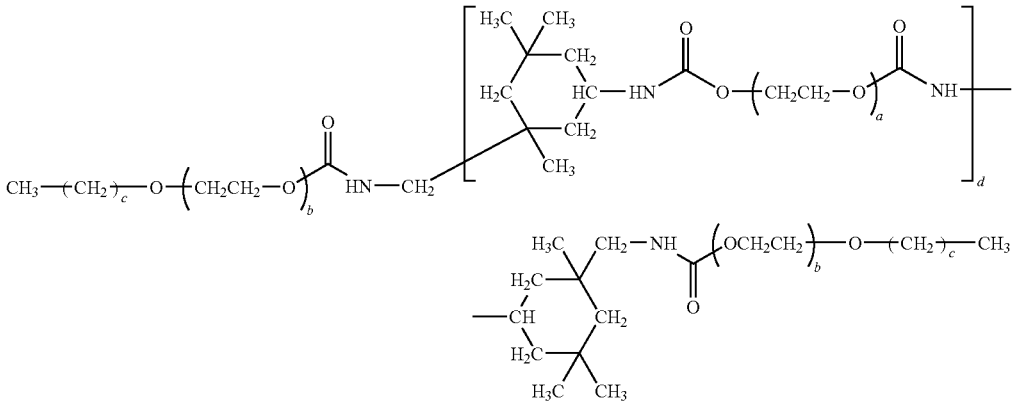

The different polymer have different value integers for a, b, c and d. For the values of a, b and d the number average of repeat units is given to represent the polymer distribution. For c the actual value of carbons repeat units is given or a range is specified.

| Polymer* | active w % | Solvent w % (balance water) | a | b | c | d |
|---|---|---|---|---|---|---|
| 1 | 30 | 10% Butyl Carbitol | 180 | 9 | 10 | 2 |
| 2 | 30 | 10% Butyl Carbitol | 180 | 13 | 13-14 | 2 |
| 3 | 25 | 10% Butyl Carbitol | 180 | 13 | 13-14 | 3 |
| 4 | 30 | 10% Butyl Carbitol | 180 | 20 | 15 | 2 |

The examples below describe liquid fabric conditioners which contain these polymers. The viscosity of each product was measured at room temperature, 24 hours after product manufacture. Two sheer rates were used 100 s-1 and 20 s-1.

The dispersion characteristics of each product when poured into water were measured using the following protocol.

10 ml of Product was added by syringe into 300 ml of tap water in a 500 ml beaker. After 30 seconds a visual assessment for dispersion of the mixture was made, with a ranking of 1-5 as follows:

Score 1: Complete spontaneous dispersion, solution will go uniformly cloudy leaving no lumps or bits Score 2: Product disperses spontaneously giving a cloudy solution with few small lumps/bits Score 3: Product disperses to give mainly small lumps/bits but with some fine dispersion to give slightly cloudy solution Score 4: Product breaks up into a few medium/large sized lumps with no fine dispersion, i.e. water remains substantially clear Score 5: Product does not break up at all on entering water. Typically forms one or two large lumps in clear water The mixture was then stirred by performing 5 strokes with a flat spatula then re-assessed using the same rating scale.

A score of 1 or 2 after stirring would give acceptable levels of dispersing in a handwash or dispensing from the drawer of an automatic washing machine.

Example 1

Liquid fabric softener composition containing an amine ester quaternary softening compound and a polyurethane polymer (Polymer 2).

| Raw Material | % Active |
|---|---|
| Demineralised water | 83.22 |
| HTTEAQ | 5.13 |
| Ceteryl Alcohol | 0.1 |
| Coco ($C_9$-$C_{11}$) 20EO nonionic | 0.2 |
| Minors | |
| Perfume | 0.32 |
| Polymer 2 | 0.50 |

HTTEAQ is hardened tallow triethanolamine quaternary based on reaction of approximately 2 moles of hardened tallow fatty acid with 1 mole triethanolamine; the subsequent reaction mixture being quaternised with dimethyl sulphate (final raw material is 85% active ingredient, the remaining 15% being Isopropanol). Minors are minor ingredients such as Dye, Anti-foam and Preservative.

HTTEAQ, Ceteryl Alcohol and Coco ($C_9$-$C_{11}$) 20EO nonionic were added to the demineralised water heated at 56° C. The mixture was stirred with an impeller blade and circulated by a pump until homogeneous.

Minors were then added over a 3 minute period and circulation was carried out for 4 minutes.

The mixture was then cooled to 45° C. over a 20 minute interval with circulation. Perfume was added, mixed and then the mixture was cooled further to a temperature of 30° C. Aqueous polymer solution of Polymer 2 was then added cold and circulated until thickening had had been obtained. The formulation was then allowed to settle for 24 hours before being tested for viscosity and dispersion characteristics.

| Viscosity mPa s at 20 $s^{-1}$ | Viscosity mPa s at 100 $s^{-1}$ | Dispersion score with no agitation | Dispersion Score after agitation with spatula |
|---|---|---|---|
| 2530 | 955 | 5 | 2 |

Example 2

Liquid fabric softener composition containing an amine ester quaternary softening compound and a polyurethane polymer (Polymer 1).

| | w % active |
|---|---|
| Raw Material | |
| Demineralised water | 83.22 |
| HTTEAQ | 5.13 |
| Ceteryl Alcohol | 0.10 |
| Coco (C9-C11) 20EO nonionic | 0.20 |
| Minors | |
| Perfume | 0.32 |
| Polymer 1 | 2.50 |

HTTEAQ, Ceteryl Alcohol and Coco (C9-C11) 20EO nonionic were added to the demineralised water heated at 56° C. The mixture was stirred with an impeller blade and circulated by a pump until homogeneous.

Minors were then added over a 3 minute period and circulation was carried out for 4 minutes.

The mixture was then cooled to 45° C. over a 20 minute interval with circulation. Perfume was added, mixed and then the mixture was cooled further to 30° C. Aqueous polymer solution of Polymer 1 was then added cold and circulated until thickening had had been obtained. The formulation was then allowed to settle for 24 hours before being tested for viscosity and dispersion characteristics.

| Viscosity mPa s at 20 $s^{-1}$ | Viscosity mPa s at 100 $s^{-1}$ | Dispersion score with no agitation | Dispersion Score after agitation with spatula |
|---|---|---|---|
| 457 | 357 | 4 | 1 |

Example 3

Liquid fabric softener composition containing an amine ester quaternary softening compound and a polyurethane polymer (Polymer 3).

| | w % active |
|---|---|
| Raw Material | |
| Demineralised water | 83.2257 |
| HTTEAQ | 5.13 |
| Ceteryl Alcohol | 0.10 |
| Coco (C9-C11) 20EO nonionic | 0.20 |
| Minors | |
| Perfume | 0.32 |
| Polymer 3 | 1.50 |

HTTEAQ, Ceteryl Alcohol and Coco (C9-C11) 20EO nonionic were added to the demineralised water heated at 56° C. The mixture was stirred with an impeller blade and circulated by a pump until homogeneous.

Minors were then added over a 3 minute period and circulation was carried out for 4 minutes.

The mixture was then cooled to 45° C. over a 20 minute interval with circulation. Perfume was added, mixed and then the mixture was cooled further to 30° C. Aqueous polymer solution of Polymer 3 was then added cold and circulated until thickening had had been obtained. The formulation was then allowed to settle for 24 hours before being tested for viscosity and dispersion characteristics.

| Viscosity mPa s at 20 $s^{-1}$ | Viscosity mPa s at 100 $s^{-1}$ | Dispersion score with no agitation | Dispersion Score after agitation with spatula |
|---|---|---|---|
| 781 | 419 | 5 | 1 |

Example 4

Liquid fabric softener composition containing an amine ester quaternary softening compound and a polyurethane polymer (Polymer 3).

| | w % active |
|---|---|
| Raw Material | |
| Demineralised water | 83.39 |
| HTTEAQ | 4.71 |
| Ceteryl Alcohol | 0.39 |
| Minors | |
| Perfume | 0.34 |
| Polymer 3 | 1.50 |

HTTEAQ and Ceteryl Alcohol were added to the demineralised water heated at 56° C. The mixture was stirred with an impeller blade and circulated by a pump until homogeneous.

Minors were then added over a 3 minute period and circulation was carried out for 4 minutes.

The mixture was then cooled to 40° C. over a 20 minute interval with circulation. Perfume was added, mixed and then the mixture was cooled further to 30° C. Aqueous polymer solution of Polymer 3 was then added cold and circulated until thickening had had been obtained. The formulation was then allowed to settle for 24 hours before being tested for viscosity and dispersion characteristics.

| Viscosity mPa s at 20 $s^{-1}$ | Viscosity mPa s at 100 $s^{-1}$ | Dispersion score with no agitation | Dispersion Score after agitation with spatula |
|---|---|---|---|
| 964 | 429 | 4 | 1 |

Example 5

Liquid fabric softener composition containing an alkyl amine quaternary softening compound and a polyurethane polymer (Polymer 2).

| | w % active |
|---|---|
| Raw Material | |
| Demineralised water | 74.71 |
| Di(hardened tallow)dimethylammonium chloride | 3.15 |

-continued

| | w % active |
|---|---|
| C16-C18 Hardened Tallow Fatty Acid | 0.42 |
| Phosphoric Acid | 0.017 |
| Minors | |
| Perfume | 0.40 |
| Polymer 2 | 0.50 |

Di(hardened tallow)dimethylammonium chloride is 75% active with 25% Isopropanol.

Phosphoric acid was added demineralised water and the temperature adjusted to 44° C. Di(hardened tallow)dimethylammonium chloride and C16-C18 Hardened Tallow Fatty Acid were added over 5 minutes. The recirculation was then turned on for 7 minutes and then the mixture was cooled to 40° C.

Minors and Perfume were then added. The mixture was then cooled to 30° C. and the product was mixed for 3 minutes. The temperature was maintained at 30° C. and the polymer solution was added. The formulation was then allowed to settle for 24 hours before being tested for viscosity and dispersion characteristics.

| Viscosity mPa s at 20 $s^{-1}$ | Viscosity mPa s at 100 $s^{-1}$ | Dispersion score with no agitation | Dispersion Score after agitation with spatula |
|---|---|---|---|
| 991 | 278 | 5 | 2 |

Example 6

Liquid fabric softener composition containing an amine ester quaternary softening compound and a polyurethane polymer (Polymer 4).

| | w % active |
|---|---|
| Raw Material | |
| Demineralised water | 83.2257 |
| HTTEAQ | 5.13 |
| Ceteryl Alcohol | 0.10 |
| Coco (C9-C11) 20EO nonionic | 0.20 |
| Minors | |
| Perfume | 0.32 |
| Polymer 4 | 1.20 |

HTTEAQ, Ceteryl Alcohol and Coco (C9-C11) 20EO nonionic were added to the demineralised water heated at 56° C. The mixture was stirred with an impeller blade and circulated by a pump until homogeneous.

Minors were then added over a 3 minute period and circulation was carried out for 4 minutes.

The mixture was then cooled to 45° C. over a 20 minute interval with circulation. Perfume was added, mixed and then the mixture was cooled further to 30° C. Aqueous polymer solution of Polymer 4 was then added cold and circulated until thickening had had been obtained. The formulation was then allowed to settle for 24 hours before being tested for viscosity and dispersion characteristics.

| Viscosity mPa s at 100 $s^{-1}$ | Viscosity mPa s at 100 $s^{-1}$ | Dispersion score with no agitation | Dispersion Score after agitation with spatula |
|---|---|---|---|
| 363 | 115 | 3 | 1 |

Example 7

A base liquid fabric softener composition was prepared from the following ingredients 4.95% Stepantex UL85 (1)
0.45% Stenol 1618L (2)
0.016% Proxel (biocide)
0.01% DC3101 (anti foam)
0.00079% Liquitint Blue MC
0.00095% Liquitint Blue 119
0.32% Softline X5
water to 100%

(1) HTTEAQ
(2) cetyl -/stearyl alcohol

Samples of the base formulation were thickened with a polymer of the invention (Polymer 2) and with a commercially available hydrophobically modified hydroxyethyl cellulose polymer (Natrasol 330). Viscosity measurements were conducted on the base formulations and each sample and the results are shown in the accompanying drawings in which.

Figure 1:
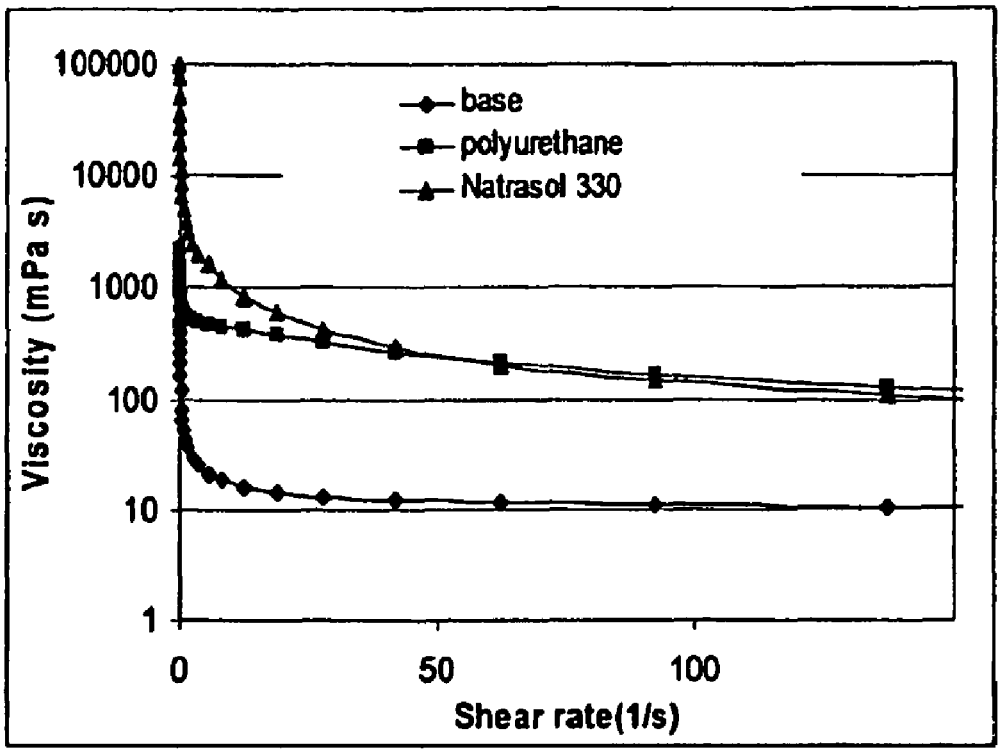
FIG. 1 shows the viscosity of each sample at different shear rates.

It will be seen from FIG. 1 that both polymers increase the viscosity of the base and show shear thinning behaviour. However the polymer of the invention has a flatter (more Newtonian) profile at the shear rates relevant to dispensing from a washing machine dispenser drawer; ~2 $s^{-1}$. This ensures good dispensing without low or no residue.

Figure 2:
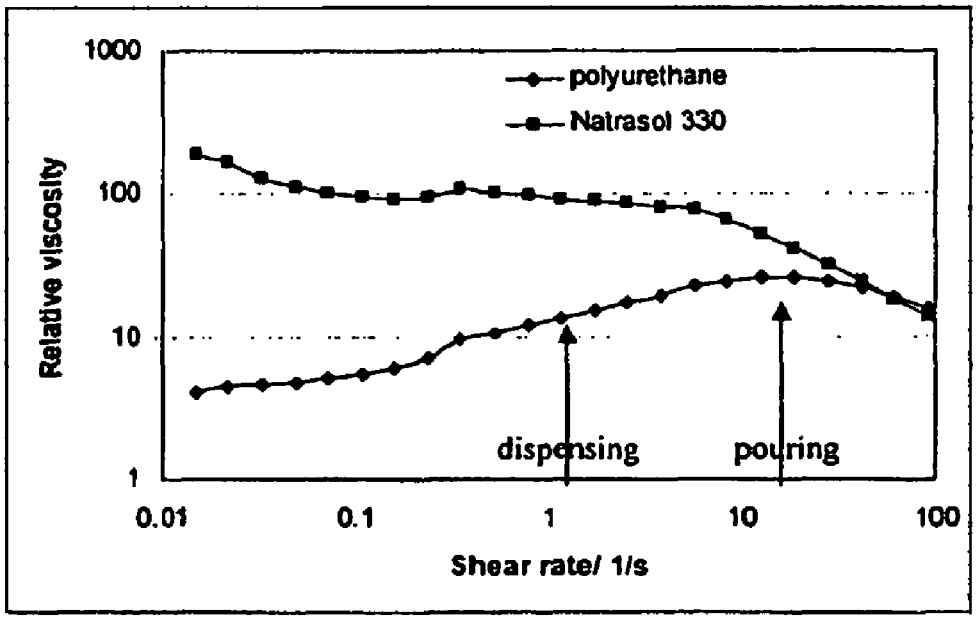
FIG. 2 shows the rheological profile of the polymer samples obtained by dividing the viscosities of the polymer samples by the viscosity of the base itself at every shear rate.

From FIG. 2 it will be seen that the polymer of the invention shows lower viscosity at the dispensing shear rate but a higher viscosity at the pouring shear rate where consumers experience the thickness effect. This type of shear profile behaviour provided by the polymers of the invention is very unexpected and novel.

The invention claimed is:

1. A liquid fabric treatment composition, comprising:

(a) a cationic fabric softening agent present in an amount of from 2 to 75%;

(b) a water-soluble linear polymeric viscosity modifier represented by the formula:

$$Z—Y—(X—Y)_n—Z$$

in which:

X represents a polyether chain, each Y independently represents a linking group derived from a diisocyanate, each Z independently represents a hydrophobic group that is an aliphatic group having from 11 to 24 carbon atoms and optionally includes a spacer linked to Y, wherein said spacer is ethoxy, propoxy or ethylene glycoxy, n represents an integer of at least 2, and the molecular weight of the polymeric viscosity modifier is from 2,000 to 80,000;

(c) from 0.3 to 2% by weight of a fatty alcohol or fatty acid containing from 8 to 22 carbon atoms; and (d) from 0.01 to 10% by weight of a nonionic surfactant.

2. The liquid fabric treatment composition according to claim 1, wherein the molecular weight of the polymeric viscosity modifier is from 7,500 to 30,000.

3. The liquid fabric treatment composition according to claim 1, in which each Z comprises an alkyl group.

4. The liquid fabric treatment composition according to claim 1, in which each Z is derived from an α-hydroxyaliphatic group or an α-aminoaliphatic group of from 11 to 24 carbon atoms.

5. The liquid fabric treatment composition according to claim 1, in which X is poly(oxyalkylene) group in which the alkylene groups contain from 2 to 6 carbon atoms.

6. The liquid fabric treatment composition according to claim 5, in which X is polyoxyethylene.

7. The liquid fabric treatment composition according to claim 1, in which Y is derived from an aliphatic, cycloaliphatic or aromatic diisocyanate.

8. The liquid fabric treatment composition according to claim 1, in which the polymeric viscosity modifier is present in an amount of from 0.001 to 2% by weight of the composition.

9. The liquid fabric softening composition as claimed in claim 1, wherein the fabric softening agent comprises a quaternary ammonium compound with ester linkages and is present in an amount of from 8 to 75% by weight of the composition.

10. The liquid fabric softening composition as claimed in claim 9, in which the fabric softening agent comprises a tallow based triethanolamine ammonium compound.

11. The fabric softening composition as claimed in claim 1, which further comprises a sucrose polyester oil.

12. A method for the treatment of fabrics comprising contacting fabrics with a liquid fabric treatment composition according to claim 1.

13. The liquid aqueous fabric softening composition as claimed in claim 1, in which Y represents a linking group derived from isophorone diisocyanate.

14. A liquid fabric treatment composition, comprising:

(a) a cationic fabric softening agent present in an amount of from 2 to 75%;

(b) a water-soluble linear polymeric viscosity modifier represented by the formula:

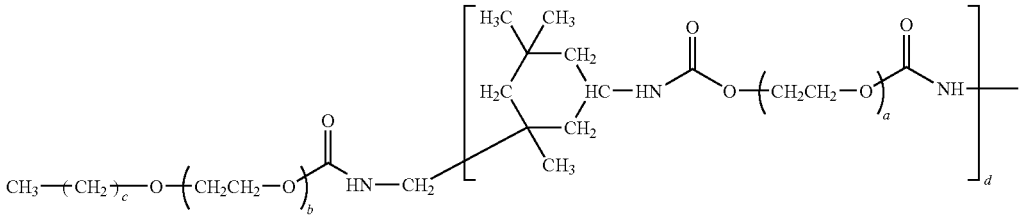

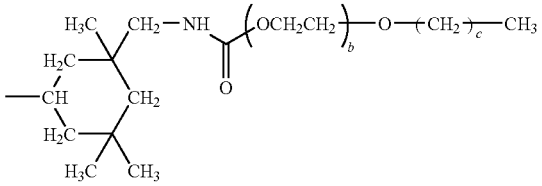

in which:

a represents an integer from 2 to 20,000, b represents an integer from 0 to 30, c represents an integer from 10 to 24, and d represents an integer from 2 to 10;

(c) from 0.3 to 2% by weight of a fatty alcohol or fatty acid containing from 8 to 22 carbon atoms; and (d) from 0.01 to 10% by weight of a nonionic surfactant.

15. A method for the treatment of fabrics comprising contacting fabrics with a liquid fabric treatment composition according to claim 14.

16. The liquid fabric softening composition as claimed in claim 14, wherein the fabric softening agent comprises a quaternary ammonium compound with ester linkages and is present in an amount of from 11 to 75% by weight of the composition.

17. The liquid fabric softening composition as claimed in claim 1, wherein the fabric softening agent comprises a quaternary ammonium compound and is present in an amount of from 8 to 75% by weight of the composition.

18. The liquid fabric softening composition as claimed in claim 1, wherein the fabric softening agent comprises a quaternary ammonium compound and is present in an amount of from 11 to 75% by weight of the composition.

* * * * *